US008505256B2

(12) United States Patent
Cerny et al.

(10) Patent No.: US 8,505,256 B2
(45) Date of Patent: Aug. 13, 2013

(54) SYNTHETIC FLOOR TILE HAVING PARTIALLY-COMPLIANT SUPPORT STRUCTURE

(75) Inventors: Ronald N. Cerny, Park City, UT (US); Dana L Hedquist, West Jordan, UT (US); Michael A. Buerger, Draper, UT (US); Gary L. Day, Bountiful, UT (US)

(73) Assignee: Connor Sport Court International, LLC, Salt Lake City, UT (US)

( * ) Notice: Subject to any disclaimer, the term of this patent is extended or adjusted under 35 U.S.C. 154(b) by 319 days.

(21) Appl. No.: 12/696,364

(22) Filed: Jan. 29, 2010

(65) Prior Publication Data

US 2011/0185658 A1 Aug. 4, 2011

(51) Int. Cl.
*E04F 15/22* (2006.01)

(52) U.S. Cl.
USPC ..... 52/403.1; 472/92; 52/263

(58) Field of Classification Search
USPC ..... 52/403.1, 181, 480, 386, 385, 263, 52/302, 586.2, 851, 852, 302.1; 472/92
See application file for complete search history.

(56) References Cited

U.S. PATENT DOCUMENTS

| | | | | |
|---|---|---|---|---|
| 658,868 | A | 10/1900 | Rosenbaumm | |
| 1,177,231 | A | 3/1916 | Carter | |
| 1,195,289 | A * | 8/1916 | Stevens | 52/402 |
| 1,425,324 | A | 8/1922 | Kennedy | |
| 1,896,957 | A | 2/1933 | Hutcheson | |
| 1,971,320 | A | 8/1934 | Cederquist | |
| 2,082,563 | A | 6/1937 | Bauer | |
| 2,653,525 | A * | 9/1953 | McGuire | 404/35 |
| 2,680,698 | A | 6/1954 | Schnee | |
| 2,810,672 | A | 10/1957 | Taylor | |
| 3,015,136 | A | 1/1962 | Doe | |
| 3,122,073 | A | 2/1964 | Masse | |
| 3,251,076 | A | 5/1966 | Burke | |
| 3,310,906 | A | 3/1967 | Glukes | |
| 3,332,192 | A | 7/1967 | Kessler et al. | |

(Continued)

FOREIGN PATENT DOCUMENTS

| | | |
|---|---|---|
| CN | 2221623 | 6/1996 |
| EP | 0 044371 | 1/1982 |

(Continued)

OTHER PUBLICATIONS

U.S. Appl. No. 12/789,161, filed May 27, 2010; Mark L. Jenkins; office action issued Sep. 1, 2010.
U.S. Appl. No. 12/774,487 filed Jan. 5, 2010; Cerny.
www.invisiblestructures.com webiste Jul. 26, 2006, 109 pages.
www.mateflex.stores.yahoo.net websiter Jul. 26, 2006, 68 pages.
www.namintec.com, website, Jul. 26, 2006, 28 pages.

(Continued)

*Primary Examiner* — Robert Canfield
*Assistant Examiner* — Matthew Gitlin
(74) *Attorney, Agent, or Firm* — Thorpe North & Western LLP

(57) ABSTRACT

A compliant insert for flexibly supporting a synthetic floor tile above a ground surface that includes one or more elongate bodies, with each elongate body having a longitudinal axis oriented parallel to a top surface of the floor tile, a top face having an attachment interface for coupling to a tile support structure extending downward from an underside of the floor tile, and a bottom face of having at least one contact flat for contacting the ground surface and at least one upwardly-directed recess for allowing liquids to flow underneath the insert. Each of the elongate bodies also has a thickness and stiffness sufficient, in an unloaded state, to elevate the support structure a distance above the ground surface.

22 Claims, 5 Drawing Sheets

(56) References Cited

U.S. PATENT DOCUMENTS 3,438,312 A 4/1969 Becker et al.
3,511,001 A 5/1970 Morgan
3,531,902 A 10/1970 Costa
3,611,609 A 10/1971 Neljnhard
3,614,915 A 10/1971 Perry
3,717,247 A 2/1973 Moore
3,735,988 A 5/1973 Palmer et al.
3,775,918 A 12/1973 Johnson
3,795,180 A * 3/1974 Larsen ..... 405/36
3,802,144 A 4/1974 Spica
3,823,521 A 7/1974 Heitholt et al.
3,909,996 A 10/1975 Ettlinger et al.
3,922,409 A 11/1975 Stark
3,925,946 A 12/1975 Balinski et al.
3,946,529 A 3/1976 Chevaux
4,008,548 A 2/1977 Leclerc
4,018,025 A 4/1977 Collette
4,054,987 A 10/1977 Forlenza
4,118,892 A 10/1978 Nakamura et al.
4,133,481 A 1/1979 Bennett
4,167,599 A 9/1979 Nissinen
D255,744 S 7/1980 Dekko
4,226,060 A 10/1980 Sato
4,226,064 A 10/1980 Kraayenhof
4,274,626 A 6/1981 Grosser et al.
4,287,693 A 9/1981 Collette
4,361,614 A 11/1982 Moffitt, Jr.
4,430,837 A 2/1984 Kirschenbaum
4,436,779 A 3/1984 Menconi et al.
4,440,818 A 4/1984 Buchan et al.
D274,948 S 7/1984 Swanson et al.
4,468,910 A 9/1984 Morrison
4,478,901 A 10/1984 Dickens et al.
4,478,905 A 10/1984 Neely, Jr. et al.
4,497,858 A 2/1985 Dupont et al.
4,509,930 A 4/1985 Schweigert et al.
4,526,347 A 7/1985 McLoughlin
4,577,448 A 3/1986 Howorth
4,584,221 A 4/1986 Kung
4,590,731 A 5/1986 DeGooyer
4,596,729 A 6/1986 Morrison
D286,575 S 11/1986 Saunders
4,640,075 A 2/1987 Nuncio
4,648,592 A 3/1987 Harinishi
4,650,180 A 3/1987 Blondel
4,681,786 A 7/1987 Brown
4,694,627 A 9/1987 Omholt
4,702,048 A 10/1987 Millman
4,715,743 A 12/1987 Schmanski
4,727,697 A 3/1988 Vaux
4,728,468 A 3/1988 Duke
4,749,302 A 6/1988 DeClute
4,766,020 A 8/1988 Ellingson, Jr.
4,807,412 A 2/1989 Frederiksen
4,819,932 A 4/1989 Trotter
4,826,351 A 5/1989 Haberhauer et al.
4,849,267 A 7/1989 Ward et al.
4,860,510 A 8/1989 Kotler
4,875,800 A 10/1989 Hicks
4,877,672 A 10/1989 Shreiner
4,917,532 A 4/1990 Haberhauer et al.
4,930,286 A 6/1990 Kotler
4,948,116 A 8/1990 Vaux
4,963,054 A 10/1990 Hayashi
5,022,200 A 6/1991 Wilson et al.
5,039,365 A 8/1991 Rutledge et al.
5,048,448 A 9/1991 Yoder
5,052,158 A 10/1991 D'Luzansky
5,111,630 A 5/1992 Munsey et al.
D327,748 S 7/1992 Dorfman, Jr.
5,143,757 A 9/1992 Skinner
5,160,215 A 11/1992 Jensen
5,185,193 A 2/1993 Phenicie et al.
5,190,799 A 3/1993 Ellingson, III
5,205,091 A 4/1993 Brown
5,205,092 A 4/1993 Taylor
5,215,802 A 6/1993 Kaars
5,228,253 A 7/1993 Wattelez
5,229,437 A 7/1993 Knight
5,234,738 A 8/1993 Wolf
5,250,340 A 10/1993 Bohnhoff
5,253,464 A 10/1993 Nilsen
5,295,341 A 3/1994 Kajiwara
5,303,669 A 4/1994 Szekely
5,323,575 A 6/1994 Yeh
5,342,141 A 8/1994 Close
5,364,204 A 11/1994 MacLeod
5,365,710 A 11/1994 Randjelovic
5,377,471 A * 1/1995 Niese ..... 52/482
5,412,917 A * 5/1995 Shelton ..... 52/403.1
5,418,036 A 5/1995 Tokikawa et al.
5,449,246 A 9/1995 Housley
5,466,489 A 11/1995 Stahl
5,509,244 A 4/1996 Bentzon
5,511,353 A 4/1996 Jones
5,527,128 A 6/1996 Rope et al.
5,542,221 A 8/1996 Streit et al.
5,609,000 A * 3/1997 Niese ..... 52/480
5,616,389 A 4/1997 Blatz
5,628,160 A 5/1997 Kung
5,634,309 A 6/1997 Polen
5,640,821 A 6/1997 Koch
5,642,592 A 7/1997 Andres
5,647,184 A 7/1997 Davis
5,682,724 A 11/1997 Randjelovic
5,693,395 A 12/1997 Wine
5,713,175 A 2/1998 Mitchell
5,713,806 A 2/1998 Teitgen et al.
5,735,096 A 4/1998 Krass
5,749,787 A 5/1998 Jank
5,758,467 A 6/1998 Snear et al.
5,761,867 A 6/1998 Carling
5,787,654 A 8/1998 Drost
5,815,995 A 10/1998 Adam
5,816,010 A 10/1998 Conn
5,816,738 A 10/1998 Harnapp
5,820,294 A 10/1998 Baranowski
5,822,828 A 10/1998 Berard et al.
5,833,386 A 11/1998 Rosan et al.
5,848,856 A 12/1998 Bohnhoff
5,865,007 A 2/1999 Bowman et al.
5,899,038 A 5/1999 Stroppiana
5,904,021 A 5/1999 Fisher
5,906,082 A 5/1999 Counihan
5,906,454 A 5/1999 Medico et al.
5,907,934 A 6/1999 Austin
5,910,401 A 6/1999 Anderson et al.
5,937,602 A 8/1999 Jalbert
5,950,378 A 9/1999 Council et al.
D415,581 S 10/1999 Bertolini
5,992,106 A 11/1999 Carling et al.
6,017,577 A 1/2000 Hostettler et al.
6,032,428 A 3/2000 Rosan et al.
6,044,598 A 4/2000 Elsasser et al.
6,047,663 A 4/2000 Moreau et al.
6,068,908 A 5/2000 Kessler et al.
6,095,718 A 8/2000 Bohnhoff
6,098,354 A 8/2000 Skandis
6,101,778 A 8/2000 Martensson
6,112,479 A 9/2000 Andres
6,128,881 A 10/2000 Bue et al.
6,134,854 A * 10/2000 Stanchfield ..... 52/480
6,171,015 B1 1/2001 Barth et al.
6,189,289 B1 2/2001 Quaglia et al.
6,228,433 B1 5/2001 Witt
6,230,460 B1 5/2001 Huyett
6,231,939 B1 5/2001 Shaw et al.
6,286,272 B1 * 9/2001 Sandoz ..... 52/177
6,301,842 B1 10/2001 Chaney et al.
6,302,803 B1 10/2001 Barlow
6,321,499 B1 * 11/2001 Chuang ..... 52/480
6,324,796 B1 12/2001 Heath
6,345,483 B1 2/2002 Clark
6,355,323 B1 3/2002 Iwen et al.

| | | | | |
|---|---|---|---|---|
| D456,533 | S | 4/2002 | Moller, Jr. | |
| 6,418,683 | B1 | 7/2002 | Martensson et al. | |
| 6,418,691 | B1 * | 7/2002 | Stroppiana | 52/480 |
| 6,428,870 | B1 | 8/2002 | Bohnhff | |
| 6,436,159 | B1 | 8/2002 | Safta et al. | |
| 6,444,284 | B1 | 9/2002 | Kessler et al. | |
| 6,451,400 | B1 | 9/2002 | Brock et al. | |
| 6,453,632 | B1 * | 9/2002 | Huang | 52/403.1 |
| 6,467,224 | B1 | 10/2002 | Bertolini | |
| 6,526,705 | B1 | 3/2003 | MacDonald | |
| 6,531,203 | B2 | 3/2003 | Kessler et al. | |
| 6,543,196 | B1 | 4/2003 | Gonzales | |
| 6,562,414 | B2 | 5/2003 | Carling | |
| 6,578,324 | B2 | 6/2003 | Kessler et al. | |
| 6,585,449 | B2 | 7/2003 | Chen | |
| 6,588,166 | B2 | 7/2003 | Martensson et al. | |
| 6,605,333 | B2 | 8/2003 | Ferreira et al. | |
| 6,606,834 | B2 | 8/2003 | Martensson et al. | |
| 6,617,009 | B1 | 9/2003 | Chen et al. | |
| D481,138 | S | 10/2003 | Forster et al. | |
| D481,470 | S | 10/2003 | Moller, Jr. | |
| 6,637,163 | B2 | 10/2003 | Thibault et al. | |
| 6,640,513 | B2 | 11/2003 | Ku | |
| 6,669,572 | B1 | 12/2003 | Barlow | |
| 6,672,970 | B2 | 1/2004 | Barlow | |
| 6,672,971 | B2 | 1/2004 | Barlow | |
| 6,682,254 | B1 | 1/2004 | Olofsson et al. | |
| D486,592 | S | 2/2004 | Hong | |
| 6,684,582 | B2 | 2/2004 | Peart et al. | |
| 6,684,592 | B2 | 2/2004 | Martin | |
| 6,695,527 | B2 | 2/2004 | Seaux et al. | |
| 6,718,714 | B1 | 4/2004 | Montgomery | |
| 6,718,715 | B2 | 4/2004 | Elliott | |
| 6,736,569 | B2 | 5/2004 | Lee | |
| 6,739,797 | B1 | 5/2004 | Schneider | |
| D492,426 | S | 6/2004 | Strickler | |
| 6,751,912 | B2 | 6/2004 | Stegner et al. | |
| 6,769,219 | B2 | 8/2004 | Schwitte et al. | |
| 6,793,586 | B2 | 9/2004 | Barlow et al. | |
| 6,802,159 | B1 | 10/2004 | Kotler | |
| 6,833,038 | B2 | 12/2004 | Iwen et al. | |
| 6,851,236 | B1 | 2/2005 | Harvey | |
| 6,878,430 | B2 | 4/2005 | Milewski et al. | |
| 6,880,307 | B2 | 4/2005 | Schwitte et al. | |
| 6,895,881 | B1 | 5/2005 | Whitaker | |
| 6,962,463 | B2 | 11/2005 | Chen | |
| 7,021,012 | B2 | 4/2006 | Zeng et al. | |
| 7,029,744 | B2 | 4/2006 | Horstman et al. | |
| 7,047,697 | B1 | 5/2006 | Heath | |
| 7,065,935 | B2 | 6/2006 | Ralf | |
| 7,090,430 | B1 | 8/2006 | Fletcher et al. | |
| 7,096,632 | B2 | 8/2006 | Pacione | |
| 7,114,298 | B2 | 10/2006 | Kotler | |
| 7,127,857 | B2 | 10/2006 | Randjelovic | |
| D532,530 | S | 11/2006 | Shuman et al. | |
| 7,131,788 | B2 | 11/2006 | Ianniello et al. | |
| 7,144,609 | B2 | 12/2006 | Reddick | |
| 7,155,796 | B2 | 1/2007 | Cook | |
| 7,211,314 | B2 | 5/2007 | Nevison | |
| 7,299,592 | B2 | 11/2007 | Moller, Jr. | |
| 7,303,800 | B2 | 12/2007 | Togers | |
| 7,340,865 | B2 | 3/2008 | Vanderhoef | |
| 7,383,663 | B2 | 6/2008 | Pacione | |
| 7,386,963 | B2 | 6/2008 | Pervan | |
| 7,412,806 | B2 | 8/2008 | Pacione et al. | |
| 7,464,510 | B2 | 12/2008 | Scott et al. | |
| 7,516,587 | B2 | 4/2009 | Barlow | |
| 7,520,948 | B2 | 4/2009 | Tavy et al. | |
| D593,220 | S | 5/2009 | Reed | |
| 7,527,451 | B2 | 5/2009 | Slater et al. | |
| 7,531,055 | B2 | 5/2009 | Mead | |
| 7,563,052 | B2 | 7/2009 | Van Reijen | |
| 7,571,572 | B2 | 8/2009 | Moller, Jr. | |
| 7,571,573 | B2 | 8/2009 | Moller | |
| RE41,140 | E | 2/2010 | Heath | |
| D611,626 | S | 3/2010 | Arden | |
| 7,676,291 | B2 | 3/2010 | Gettig | |
| 7,704,011 | B2 | 4/2010 | Marshall | |
| 7,748,176 | B2 | 7/2010 | Harding et al. | |
| 7,748,177 | B2 | 7/2010 | Jenkins et al. | |
| 7,900,416 | B1 | 3/2011 | Yokubison et al. | |
| 7,950,191 | B2 | 5/2011 | Brouwers | |
| 2001/0002523 | A1 * | 6/2001 | Chen | 52/263 |
| 2002/0108340 | A1 * | 8/2002 | Elliott | 52/403.1 |
| 2002/0152702 | A1 | 10/2002 | Tseng | |
| 2003/0009971 | A1 | 1/2003 | Palmberg | |
| 2003/0148813 | A1 | 8/2003 | Barlow | |
| 2003/0190969 | A1 | 10/2003 | Barlow et al. | |
| 2004/0023006 | A1 | 2/2004 | Mead | |
| 2004/0035079 | A1 | 2/2004 | Evjen | |
| 2004/0182030 | A1 | 9/2004 | Hinault et al. | |
| 2004/0226242 | A1 | 11/2004 | Moller, Jr. | |
| 2004/0235580 | A1 | 11/2004 | Barlow et al. | |
| 2004/0258869 | A1 | 12/2004 | Walker | |
| 2005/0016098 | A1 | 1/2005 | Hahn | |
| 2005/0028475 | A1 | 2/2005 | Barlow et al. | |
| 2005/0102936 | A1 * | 5/2005 | Chen et al. | 52/263 |
| 2005/0144867 | A1 | 7/2005 | Clarke | |
| 2005/0193669 | A1 | 9/2005 | Jenkins et al. | |
| 2005/0193670 | A1 | 9/2005 | Niese et al. | |
| 2005/0204676 | A1 | 9/2005 | Weitzer | |
| 2005/0252109 | A1 | 11/2005 | Fuccella et al. | |
| 2006/0070314 | A1 | 4/2006 | Jenkins et al. | |
| 2006/0080909 | A1 | 4/2006 | Harding et al. | |
| 2006/0265975 | A1 | 11/2006 | Geffe | |
| 2006/0272252 | A1 | 12/2006 | Moller, Jr. | |
| 2006/0283118 | A1 | 12/2006 | Moller, Jr. | |
| 2006/0283125 | A1 | 12/2006 | Moller, Jr. | |
| 2006/0285920 | A1 | 12/2006 | Gettig et al. | |
| 2007/0214741 | A1 | 9/2007 | Llorens Miravet | |
| 2007/0289244 | A1 | 12/2007 | Haney et al. | |
| 2008/0092473 | A1 | 4/2008 | Heyns | |
| 2008/0127593 | A1 | 6/2008 | Janesky | |
| 2008/0168736 | A1 | 7/2008 | Pervan | |
| 2008/0172968 | A1 | 7/2008 | Pacione | |
| 2008/0216437 | A1 | 9/2008 | Prevost et al. | |
| 2008/0271410 | A1 | 11/2008 | Matthee | |
| 2008/0295437 | A1 | 12/2008 | Dagger | |
| 2009/0031658 | A1 | 2/2009 | Moller, Jr. | |
| 2009/0049768 | A1 | 2/2009 | Kim | |
| 2009/0094918 | A1 | 4/2009 | Murphy et al. | |
| 2009/0139160 | A1 | 6/2009 | Hill | |
| 2009/0235605 | A1 | 9/2009 | Haney | |
| 2010/0236176 | A1 | 9/2010 | Jenkins | |
| 2011/0045916 | A1 * | 2/2011 | Casimaty et al. | 472/92 |

FOREIGN PATENT DOCUMENTS

| | | |
|---|---|---|
| FR | 2240320 | 3/1975 |
| GB | 1504811 | 3/1978 |
| GB | 2 262 437 | 6/1993 |
| GB | 2263644 A | 8/1993 |
| GB | 2353543 | 2/2001 |
| GB | 2353543 | 8/2001 |
| JP | 3045788 | 11/1997 |
| JP | 2000248729 | 9/2000 |
| KR | 10-0743984 | 8/2007 |

OTHER PUBLICATIONS www.polypavement.com/costs.htm, website Mar. 24, 2006, pp. 1-2.
www.polypavement.com/more_info.htm, website Mar. 24, 2006 pp. 1-12.
www.polypavement.com/index.htm, website Mar. 24, 2006, pp. 1-6.
Yokubison et al., U.S. Appl. No. 11/729,547, filed Mar. 28, 2007.
Yokubision et al., U.S. Appl. No. 11/731,017, filed Mar. 28, 2007.
Yokubision et al., U.S. Appl. No. 11/729,549, filed Mar. 28, 2007.
Jenkins et al., U.S. Appl. No. 11/065,192, filed Feb. 24, 2005.
Affidavit of Christopher Butler; signed Jan. 24, 2011; received by Thorpe North and Western on Jul. 8, 2011; 13 pages.
PCT Application PCT/US2011/022802; filed Jan. 28, 2011; Ronald N. Cerny; International Search Report mailed Sep. 28, 2011.
Inter Partes Reexamination for Patent No. 7,748,177; Request filed Dec. 29, 2011; 192 pages.
U.S. Appl. No. 95/000,651; filed Dec. 29, 2011; office action issued Feb. 3, 2012.

* cited by examiner

SYNTHETIC FLOOR TILE HAVING PARTIALLY-COMPLIANT SUPPORT STRUCTURE

FIELD OF THE INVENTION

The present invention relates to support systems for modular synthetic flooring assemblies, and more specifically to a compliant insert for flexibly supporting a modular synthetic floor tile configured for sports play.

BACKGROUND OF THE INVENTION AND RELATED ART

Numerous types of flooring assemblies have been used to create playing areas for such sports as basketball and tennis, as well as for other purposes. These flooring assemblies include concrete, asphalt, wood and other materials which have varying characteristics. For each type of flooring, there are corresponding advantages and disadvantages. For example, concrete flooring is easy to construct and provides long term wear. However, the concrete provides no "give" during use and many people are injured each year during sporting events due to falls and other mishaps on concrete surfaces. Wood floors, such as are used for many basketball courts, have an appropriate amount of give to avoid such injuries. However, wood floors are also expensive to install, require constant maintenance to keep them in good condition, and are not suitable for extended outdoor use.

Due to these concerns, the use of modular flooring assemblies made of synthetic materials has grown in popularity. The synthetic floors are advantageous for several reasons. A first reason for the flooring assemblies' popularity is that they are typically formed of materials which are generally inexpensive and lightweight. If a tile is damaged it may easily be replaced. If the flooring needs to be temporarily removed, the individual tiles making up the floor can easily be detached, relocated, and then reattached to form a new floor in another location.

A second reason for the popularity of the flooring assemblies is that the durable plastics from which they are formed are long lasting. However, unlike other long lasting alternatives such as asphalt and concrete, the synthetic material forming the modular floor tile is generally better at absorbing impacts, and there is less risk of injury if a person falls on the plastic material, as opposed to concrete or asphalt. Additionally, the synthetic flooring assemblies generally require little maintenance as compared to other flooring, such as wood. However, there is a need for synthetic flooring to have better impact absorbing qualities than that found in current synthetic sports floor coverings. In particular, current synthetic flooring systems installed outdoors and built to withstand wet environment conditions do not have the same spring or bounce characteristics as those found in protected indoor sports flooring assemblies made with wood and other materials.

Therefore, it would be advantageous to provide a modular tile system that facilitates greater "give" to impacts as well as providing a spring characteristic to the flooring tile that is comparable or superior to that found in wood flooring, while also being easy to manufacture, long lasting and cost efficient, and capable of being installed outdoors.

SUMMARY OF THE INVENTION

In accordance with a representative embodiment broadly described herein, the present invention comprises a compliant insert for flexibly supporting a synthetic floor tile above a ground surface. The insert includes one or more elongate bodies, each elongate body having a longitudinal axis oriented parallel to a top surface of the floor tile, a top face having an attachment interface for coupling to a tile support structure extending downward from an underside of the floor tile, and a bottom face of having at least one contact flat for contacting the ground surface and at least one upwardly-directed recess for allowing liquids to flow underneath the insert. Each of the elongate bodies also has a thickness and stiffness sufficient, in an unloaded state, to elevate the support structure a distance above the ground surface.

In accordance with another representative embodiment broadly described herein, the present invention comprises a compliant insert for flexibly supporting a synthetic floor tile above a ground surface that includes one or more elongate bodies having a longitudinal axis oriented parallel to a top surface of the floor tile, and a thickness and stiffness sufficient, in an unloaded state, to elevate the floor tile a distance above the ground surface. Each of the elongate bodies further includes a bottom face having at least one contact flat for contacting the ground surface, a top face having an attachment interface for coupling the insert to a tile support structure extending downwardly from an underside of the floor tile, and at least one drainage channel for channeling liquids away from the floor tile. The drainage channel can be formed into the top face, the side face, or both the top and sides faces of the elongate body.

In accordance with yet another representative embodiment broadly described herein, the present invention comprises a compliant insert for flexibly supporting a synthetic floor tile above a ground surface that includes one or more elongate bodies having a longitudinal axis oriented parallel to a top surface of the floor tile, and a thickness and stiffness sufficient, in an unloaded state, to elevate the floor tile a distance above the ground surface. Each of the elongate bodies further includes a bottom face having at least one contact flat for contacting the ground surface, and a top face having at least one attachment groove formed therein for receiving a support rib extending downwardly from an underside of the floor tile to establish a rib/groove interconnection coupling the insert to the floor tile.

In accordance with yet another representative embodiment broadly described herein, the present invention comprises a modular tile system forming a partially-compliant floor covering over a ground surface comprising a modular floor tile and one or more compliant inserts. The modular floor tile includes a substantially planar body having top surface and a tile support structure extending downwardly from the underside of the planar body. Each of compliant inserts includes at least one elongate body having a longitudinal axis oriented parallel to a top surface of the floor tile and a thickness and stiffness sufficient, in an unloaded state, to elevate the tile support structure a distance above the ground surface, a bottom face having at least one contact flat for contacting the ground surface, a top face having an attachment interface for coupling the insert to the tile support structure, and at least one drainage channel transverse to the longitudinal axis for channeling liquids away from the floor tile.

BRIEF DESCRIPTION OF THE DRAWINGS

Features and advantages of the present invention will be apparent from the detailed description that follows, and when taken in conjunction with the accompanying drawings together illustrate, by way of example, features of the invention. It will be readily appreciated that these drawings merely depict representative embodiments of the present invention and are not to be considered limiting of its scope, and that the components of the invention, as generally described and illustrated in the figures herein, could be arranged and designed in a variety of different configurations. Nonetheless, the present invention will be described and explained with additional specificity and detail through the use of the accompanying drawings, in which.

DETAILED DESCRIPTION OF EXEMPLARY EMBODIMENTS

The following detailed description makes reference to the accompanying drawings, which form a part thereof and in which are shown, by way of illustration, various representative embodiments in which the invention can be practiced. While these embodiments are described in sufficient detail to enable those skilled in the art to practice the invention, it should be understood that other embodiments can be realized and that various changes can be made without departing from the spirit and scope of the present invention. As such, the following detailed description is not intended to limit the scope of the invention as it is claimed, but rather is presented for purposes of illustration, to describe the features and characteristics of the representative embodiments, and to sufficiently enable one skilled in the art to practice the invention. Accordingly, the scope of the present invention is to be defined solely by the appended claims.

Furthermore, the following detailed description and representative embodiments of the invention will be best understood with reference to the accompanying drawings, wherein the elements and features of the embodiments are designated by numerals throughout.

Illustrated in FIGS. 1-6 are several representative embodiments of a compliant or resilient insert for flexibly supporting a synthetic floor tile above a ground surface, as well as a modular tile system which is assembled to form a partially-compliant floor covering. As described herein, the compliant insert and modular tile system can provide several significant advantages and benefits over other systems and methods of making a floor covering which can be used for sports play, including outdoor sporting activities. However, the recited advantages are not meant to be limiting in any way, as one skilled in the art will appreciate that other advantages may also be realized upon practicing the invention.

Figure 1:
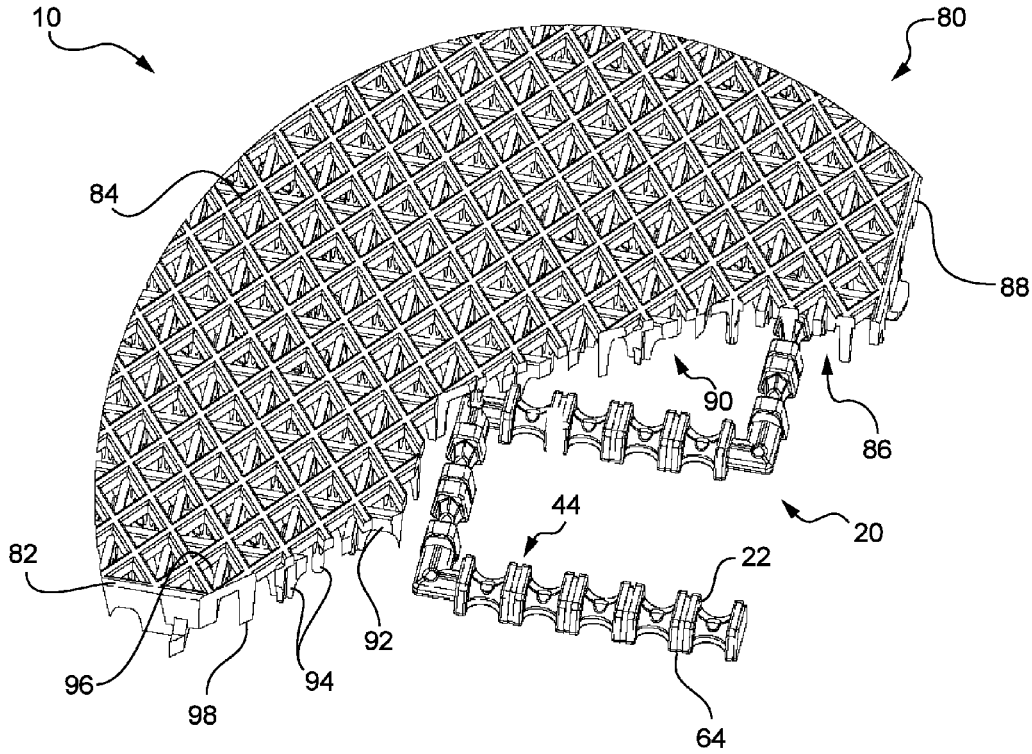
FIG. 1 is an cut-away assembly view of a modular tile system forming a partially-compliant floor covering over a ground surface, in accordance with a representative embodiment of the present invention.

FIG. 1 is a cut-away assembly view of a modular floor tile system 10 which can be used to form a partially-compliant floor covering over a ground surface, in accordance with a representative embodiment of the present invention. The modular tile system 10 includes a synthetic modular floor tile 80 comprising a generally planar body 82 having a top surface 84, an underside 86, and periphery-defining sidewalls 88. A tile support structure 90 extends downward from the underside 86 to support and raise the planar body 82 above a ground surface. The planar body 82 of the floor tile can have drainage holes 96 formed therein. In one aspect, the support structure can comprise an array or grid of downwardly-extending load-bearing structures, such as ribs 92 and posts or columns 94, etc., that alternate with the periodic openings 96 in the planar body and the tile support structure to form a support structure 90 having both stiffness and damping performance characteristics. The post or columns 94 can have contact surfaces 98 at the lower ends thereof for contacting the ground surface.

The stand-alone performance characteristics of the tile support structure 90 can be predetermined through variations in the size, shape and material composition of the planar tile body 82 and the load-bearing structures 92, 94. For instance, the tile support structure 90 and the planar body 82 of the modular floor tile 80 can be integrally formed together from a durable plastic or polymer material having an elastic modulus that is high enough to support the weight of an individual walking or standing on the top surface 84 without significant deflection, but low enough to elastically compress and deform during a high-energy impact to the top surface to absorb a portion of the transient impact energy and transfer the remainder of the energy to ground without damage to the floor tile.

In the present invention, the tile support structure 90 provides for the attachment of one or more resilient or compliant inserts 20 to the floor tile in addition to supporting the floor tile 80 during an impact. The compliant inserts are used to modify and enhance upon the load-bearing performance characteristics of the tile support structure and to form a partially-compliant floor covering. Additionally, the compliant inserts 20 can have a height and stiffness that are sufficient, in an unloaded state, to elevate the lower contact surfaces 98 of the load-bearing structure 94 a distance above the ground surface.

The compliant inserts 20 can be formed from a more-flexible plastic or rubber-like material having an elastic modulus that is lower than the elastic modulus of the floor tiles, and when attached to the underside tile support structure can elastically compress and deform prior to the tile support structure 90 coming into contact with the ground surface so as to provide the modular tile system 10 with a extra degree of compliance. In one aspect the inserts can have an ASTM D2240 durometer value ranging from about 25 to about 50, and can be sufficiently compliant or elastic to compress or deform under a lighter walking and standing load. In other aspects the inserts can have an ASTM D2240 durometer value ranging from about 50 to about 75, and can provide enough stiffness to resist deflection under the lighter walking and standing loads, but which will elastically compress or deform under a moderate load and high-energy impact forces.

In yet another aspect, the tile support structure 90 itself can include a plurality of load-bearing members 94 that provide multiple levels or degrees of stiffness and damping, such as a first group of semi-rigid load-bearing members which will deflect or deform upon contact with the ground surface to allow a second group of more rigid load-bearing members to come into contact the ground surface and carry the remainder of an impact load or a heavy load. Thus, a modular floor tile system 10 having a multi-level support configuration 90 combined with the compliant inserts 20 can have three or more levels or degrees of support, such as a first elastic level, a second semi-rigid level and a thirst most-rigid level. This advantageously provides for the various forces and loadings applied to the top surface 84 of the floor tile 80 to be absorbed and/or distributed in controllable stages.

Figure 2:
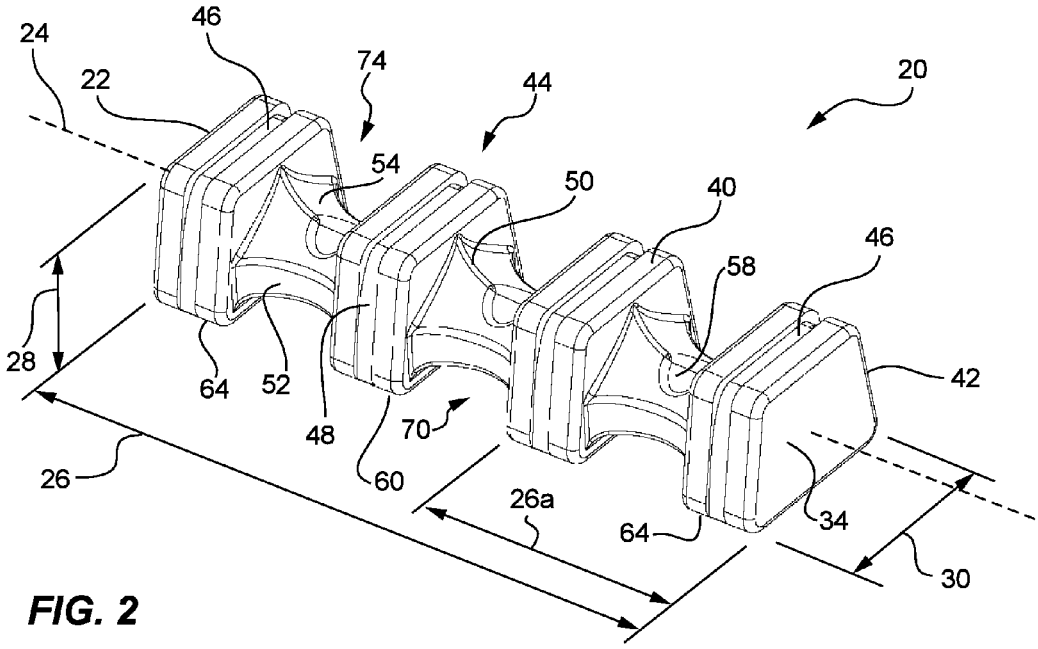
FIG. 2 is a perspective view of a compliant insert, in accordance with another representative embodiment of the present invention.

Illustrated in FIG. 2 is a perspective view of one aspect of the resilient or compliant insert 20 which can be installed into the underside support structure or array 90 of the modular floor tile of FIG. 1. The compliant insert 20 comprises one or more solid elongate bodies 22 having a longitudinal axis 24 that is oriented parallel to the top surface of the floor tile and to the ground surface when installed. The elongate body has a length 26, a height (or thickness) 28 and a width 30. In the embodiment shown, the width can be roughly equivalent to the height or thickness and the length 26 of the elongate body 22 can be more than two times its thickness 28, so as to provide an elongate grouping of contact flats 64 with the ground surface. In another aspect the elongate body can be configured with a shorter length 26*a* that may be less than two times its thickness 28 so as to provide a more limited or smaller grouping of contact flats with the ground surface.

The elongate body 22 has a top face 40 with one or more attachment interfaces 44 that are distinguishable from the contact flats 64 on the bottom face 60. In one aspect the compliant insert 20 can include at least two contact flats located at either end of the elongate body 22 to provide a stable base for the attachment interface 44 positioned directly above or supported above and between the contact flats.

Referring now to both FIG. 1 and FIG. 2, the one or more attachment interfaces 44 couple the compliant insert 20 to the tile support structure 90, and can comprise indentations or receptacles, such as attachment grooves 46 or attachment holes 58, etc., that are complimentary with the array of load-bearing structures 92, 94 projecting downwardly from the underside of the floor tile. In one aspect the attachment interfaces can receive the load-bearing structures with slight interference fits that secure the insert 20 within the supporting array 90 until it is forcibly or intentionally removed.

Alternatively, the attachment interfaces formed into the compliant insert can comprise the projecting structures while the support structure can include the receiving indentations or receptacles. Regardless of the allocation of projecting structures and receiving indentations between the compliant inserts 20 and the support structure 90, the male/female-type interconnection can provide a secure mechanical fit between the two bodies that holds the compliant insert 20 to the underside of the floor tile 80 as it is moved about, stored and transported after attachment to the underside supporting array Other means for securing the compliant insert 20 to the underside 86 of the synthetic modular floor tile 80 are also possible, including adhesives, thermal bonding, and alternative structural arrangements such as snap clips or fasteners, and/or combinations thereof, etc. Furthermore, the compliant insert 20 can be removable from the supporting structure or array 90 and replaceable with a different compliant insert having modified dimensions and/or different material properties, in order to reconfigure the modular floor tile system or partially-compliant floor covering with different load-bearing performance characteristics.

The modular floor tile system 10 of the present invention can be further advantageous by allowing the one or more compliant inserts 20 to be insertable anywhere within the tile support structure 90, and in any orientation which conforms with the repeating pattern of the load-bearing structures 92, 94 and openings 96 forming the supporting array. Moreover, the compliant inserts 20 may not be limited to floor tiles having specially-configured underside structures or receivers that have been tailored or modified to accommodate a specific resilient member or body. Instead, the compliant inserts 20 can be configured for installation "after-the-fact" into any pre-existing modular synthetic floor tile having a repeating pattern of load-bearing structures which can accommodate the plurality of elongate bodies 22 having longitudinal axes 24 oriented parallel to the top surface 84 of the floor tile, as described above.

The one or more contact flats 64 formed into the bottom face 60 of the compliant insert 20 can comprise a substantially uniform surface (whether smooth, textured or roughened) that is configured to contact and provide a degree of traction with several types of ground surfaces. In general, the type of ground surface most suitable for use with the compliant insert described herein is flat and hard, and can include concretes, cements, asphalt, stone, ceramic tiles, wooden flooring and synthetic sub-flooring tiles and the like. However, in other aspects the modular tile system can also be used with alternative ground surfaces such as carpet, sand, soil and aggregates, etc.

The contact flats 64 can be configured to either grip to or slide over the ground surface, or a combination of both gripping and sliding depending upon type of underlying ground surface and the loading applied to the top surface of the floor tile. Whether the contacts flats grip or slide can be a function of the total surface area between the ground surface and the summation of all the contact flats of the compliant inserts supporting a particular modular floor tile. For instance, it may be desirable that a partially-compliant floor covering assembled from a plurality of modular floor tile systems 10 be configured with a degree of lateral flexibility as well as vertical compliance, so that the floor tile 80 can both translate laterally and compress vertically in response to a transient impact force or load applied to the top surface 84, such as by a user engaged in active sports play. Such lateral flexibility can allow the modular floor tile to press up against the sides of adjacent floor tiles and distribute a portion of the impact loading to the remainder of the floor covering. The lateral flexibility can also function to elastically absorb and dissipate a portion of the impact forces and thereby reduce the energy of the shock or impact reflected back to the user, resulting in a corresponding reduction in the risk of injury.

It may also be desirable to control the degree of lateral compliance or traction of the modular floor tile system 10, so as to provide a firm but yielding lateral response to a user engaged in active sports play. This can be done in a variety of ways with the compliant insert 20 of the present invention. For instance, one factor can be the total contact surface area between the ground surface and all the contact flats 64 of the compliant inserts 20 supporting the particular floor tile 80. While too much contact area can prohibit the desired amount of lateral movement, too little contact area may not provide sufficient traction to restrain the floor tile.

The material comprising the compliant inserts 20 can also be a factor. For example, the contact flats 64 of a compliant insert made from a more elastic material can be configured to compress and firmly grip the ground surface in response to a vertical component of the transient impact or load, causing the flexible elongate body 22 to flex or bend laterally in the direction of the horizontal component and thus allow slight lateral movements of the modular floor tile 80 carried above. In another aspect the contact flats 64 of a compliant insert made from a more-rigid material configured to resist gripping the ground surface in response to a vertical component of the transient impact, and instead slide across the ground surface in the direction of the horizontal component, which also allows for lateral movement of the modular floor tile 80 carried above. Combinations of the two characteristics, such as first gripping and then sliding, are also possible.

It is to be appreciated that the type and degree of lateral compliance and traction provided by the compliant insert can be controllable. Both characteristics can be a function of the friction interface between the contact flats 64 and the ground surface, the modulus of elasticity of the material forming the compliant inserts, the height, width and orientation of the elongate bodies 22 relative to the horizontal component of the transient impact, and the total contact surface area between the ground surface and all the contact flats of the compliant inserts 20 supporting the particular floor tile 10.

Referring back to FIG. 2, the bottom face 60 of the compliant insert 20 can also include one or more upwardly-directed flow recesses 70 that extend transversely from side-to-side underneath the elongate body 22 and permit liquids or water to flow underneath portions of the insert for drainage purposes. The flow recesses can be of uniform height, and in one embodiment can have a length greater than the length of an adjacent contact flat 64, to both maximize the size of the flow passages relative to the length 26 of the elongate body and to limit the surface area of the contact flat. The flow recesses can also sub-divide the contact flats 64 into an elongate grouping of contact flats dispersed along the length of the elongate body, and which provide a stable base for the attachment interfaces 44 positioned directly above or supported above and between the contact flats.

The top face 40 of the elongate body 22 can also have one or more drainage structures in addition to the attachment interfaces 44, such as the top drainage channels 50 that facilitate the drainage of liquids or water from the top surface of the modular floor tile to the ground surface below. The top drainage channels can be aligned transverse to the longitudinal axis 24 and can configured with a predetermined drainage channel curve 54 that is optimized to draw down the liquids or water from above and to shed the fluids onto the floor surface below using various flow mechanisms. In one aspect the drainage channels can have a curvilinear shape with a radius of curvature ranging between 0.1 inch and 0.5 inch. The top drainage channels can also sub-divide the attachment interfaces 44 into a plurality of attachment interfaces dispersed along the length 26 of the elongate body and transverse to the longitudinal axis, so as to provide an elongate grouping of attachment interfaces that interconnect with the repeating array or grid of load bearing structures forming the underside support structure.

The side faces 42 of the elongate body can also have one or more side drainage channels 52 that facilitate the drainage of liquids or water from the top surface of the modular floor tile to the ground surface below. The side drainage channels can also be configured with the predetermined drainage channel curve 54, and can provide the additional benefit of minimizing the visible surface area of the top face 40 as viewed from above, so that the compliant insert 20 can remain better hidden from view behind the support structures of a floor tile having a plurality of openings in its top surface.

Combining the top 50 and side 52 drainage channels into the same location on the elongate body 22 can further improve the drainage characteristics of the compliant insert 20, and when aligned with the apertures in the surface of the floor tile can be an effective solution for removing water from the top of the floor tile and distributing it to the ground surface below. Accordingly, the top drainage channels 50, side drainage channels 52 and flow recesses 70 of the compliant insert 20 can be aligned together along the longitudinal axis 24 of the elongate body 22 to form narrow or necked portions 74 configured to facilitate the drainage or passage of water.

Furthermore, the necked portions can alternate with expanded portions having the attachments interfaces 44 above that are axially aligned with the contact flats 64 below to form load-bearing support columns 34 between the ground surface and the tile support structure. The height 28 of the support columns 34 (e.g. also the thickness of the elongate body 22) combined with the stiffness of the material forming the solid elongate body 22 is sufficient, in an unloaded state, to elevate the support structure of the modular synthetic floor tile a distance above the ground surface.

The attachment interface 44 can comprise a top groove 46 adapted to receive a supporting rib from a grid of supporting ribs forming the tile support structure, and therein form a rib/groove interconnection. The top groove 46 can have a predetermined width that is equal to or slightly smaller than the thickness of the supporting rib so that the rib/groove interconnection becomes an interference fit which operates to secure the compliant insert 20 within the tile support structure until it is forcibly removed. Also shown in FIG. 2, the top grooves 46 formed into the top surface 40 can be transverse to the longitudinal axis 24 and can continue around the side faces 42 of the elongate body to form side grooves 48, resulting in a three-sided attachment interface.

The attachment interface 44 in the top face 40 of the elongate body 22 can also include one or more attachment holes 58 for receiving another type of load-bearing structure, such as a support post or column, and create a post/hole interconnection. The attachment holes 58 can have a predetermined diameter that is equal to or slightly smaller than the diameter of the support posts to form another interference fit operating to secure the compliant insert 20 within the tile support structure. As shown with the representative compliant insert 20 illustrated in FIG. 2, the attachment holes 58 can be positioned between adjacent top grooves 46 and aligned through the center of the drainage channel 50 in the top face and the drainage recess 70 in the bottom face 60.

Figure 3A:
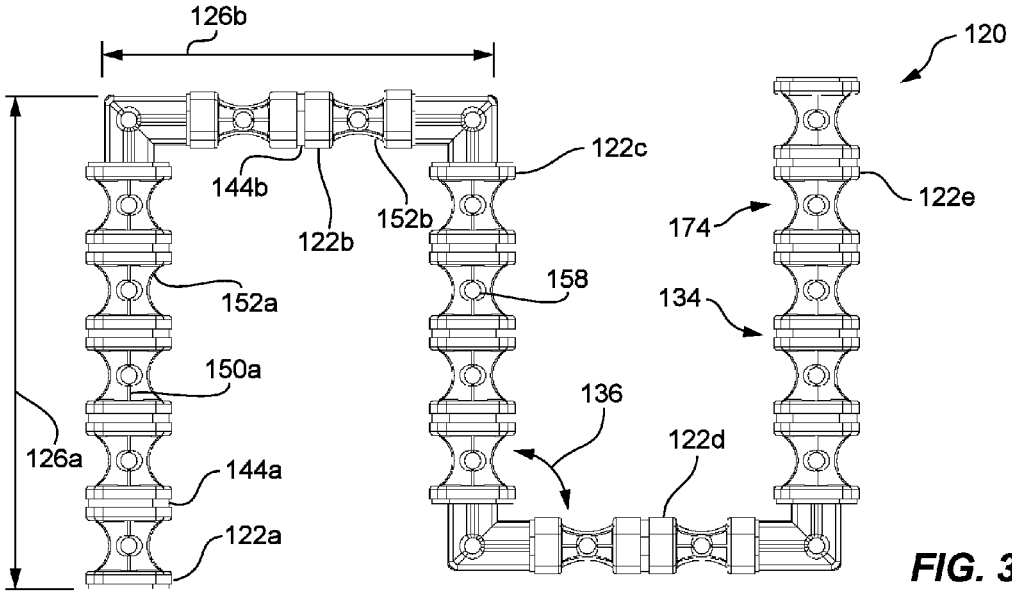
FIGS. 3A-3C together illustrate the top, side and bottom views of a representative compliant insert, in accordance with another embodiment of the present invention.
Figure 3B:
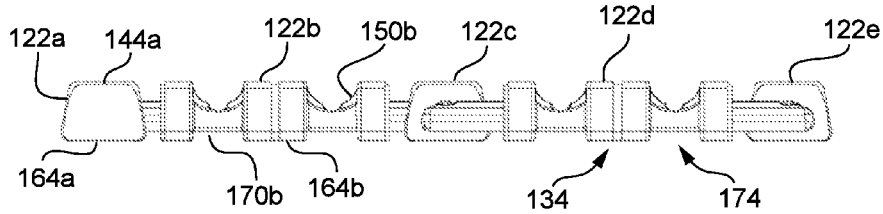
Figure 3C:
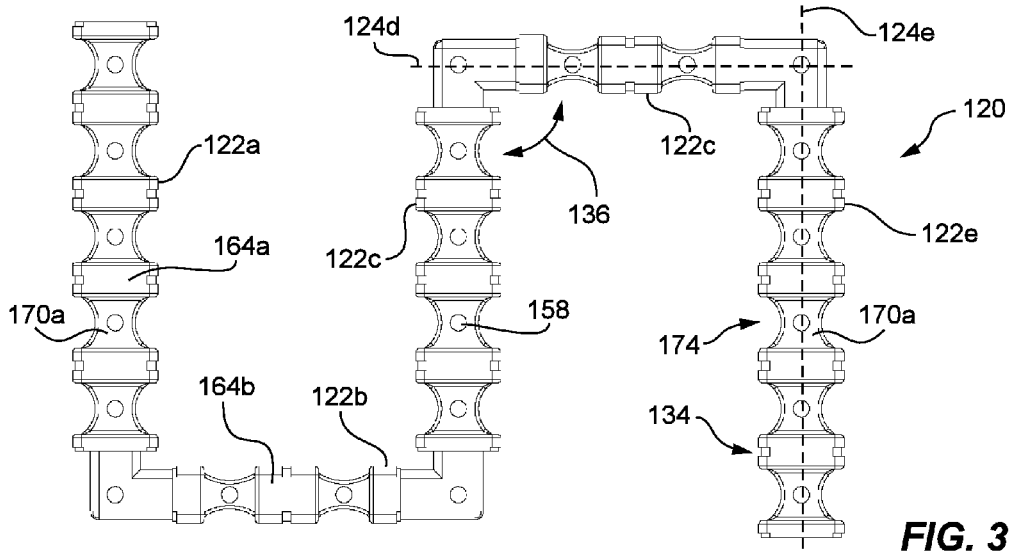

The top, side and bottom views of another representative embodiment 120 of the resilient or compliant insert are illustrated in FIGS. 3A-3C. The compliant insert can comprise multiple elongate bodies 122*a*-122*e* joined together at angles 136 to form a shaped compliant insert (e.g. the S-shaped insert formed from five elongate bodies or segments) that supports the modular floor tile in a plane. The shaped compliant insert can be formed into any open or closed shape, such as a square, that can be contemplated by one having skill in the art, and which includes one or more elongate bodies having a longitudinal axis oriented parallel to the ground surface or the top surface of the synthetic floor tile. Moreover, it is to be appreciated that the compliant insert of the present invention is not limited to elongate linear segments joined end-to-end at right angles, and can also comprise compliant inserts having multiple elongate bodies forming polygonal shapes such as triangles, pentagons, hexagons, octagons, etc., or elongate curved shapes and elongate round shapes, and even elongate irregular shapes such as stars or asterisks having elongate segments projecting radially from a center portion, etc.

Although joined together to form a single compliant insert, the multiple elongate bodies may not be identical and variations can occur between the segments. For instance, some of the elongate bodies 122*b*, 122*d* of the compliant insert embodiment 120 shown in FIGS. 3A-3C can have a length 126*b* that is different (e.g. shorter) than the length 122*a* of the other elongate bodies, 122*a*, 122*c*, 122*e*. Additionally, the attachment interface 144*b*, the top and side drainage channel

150*b*, 152*b*, and the contact flat 164*b* structures of one elongate segment 122*b* can be different than the attachment interface 144*a*, drainage channels 150*a*, 152*a* and contact flat 164*a* structures of another elongate segment 122*a*. This capacity for variation allows the compliant insert 120 to be installed into a floor tile having an irregular support structure or array, such as a repeating pattern of alternating load-bearing structures and gaps along one horizontal axis that is different than the repeating pattern of alternating load-bearing structures and gaps along the other.

Similar to the compliant insert embodiment 20 described and illustrated in FIG. 2 above, the top drainage channels 150, side drainage channels 152 and flow recesses 170 of the compliant insert 120 of FIGS. 3A-3C can be aligned along the longitudinal axes 124*d*, 124*e* of the various elongate bodies 122 to form a plurality of narrow or necked portions 174 that facilitate the drainage of water from above and the passage of water below. Likewise, the narrow drainage portions 174 of the elongate bodies 122 can alternate with expanded portions having attachment interfaces 144 on the top face 140 that are axially aligned with contact flats 164 on the bottom face 160 to form vertical load-bearings support columns 134 between the ground surface and the tile support structure. The narrow drainage portions 174 can include attachment holes 158 adapted to receive a round support post projects complete through the body of the insert to the flow recess 170 below. The engagement between the support posts and the attachment holes forms a plurality of post/hole interconnections that are complimentary with the plurality of rib/groove interconnections, and which together can mechanically secure the compliant insert 120 to the modular floor tile until it is intentionally removed.

Figure 4A:
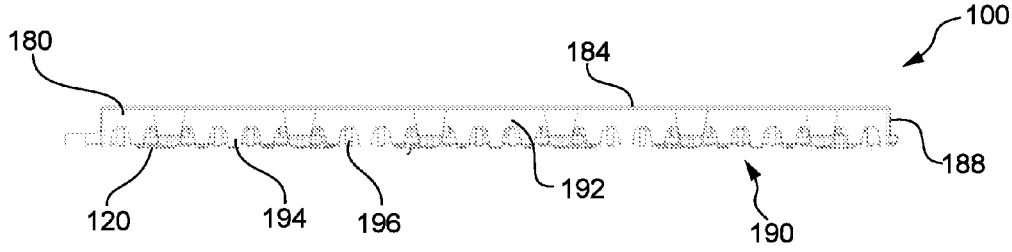
FIGS. 4A-4B together illustrate the side and bottom views of a modular synthetic floor tile incorporating several of the compliant inserts of FIG. 3, in accordance with another representative embodiment of the present invention.
Figure 4B:
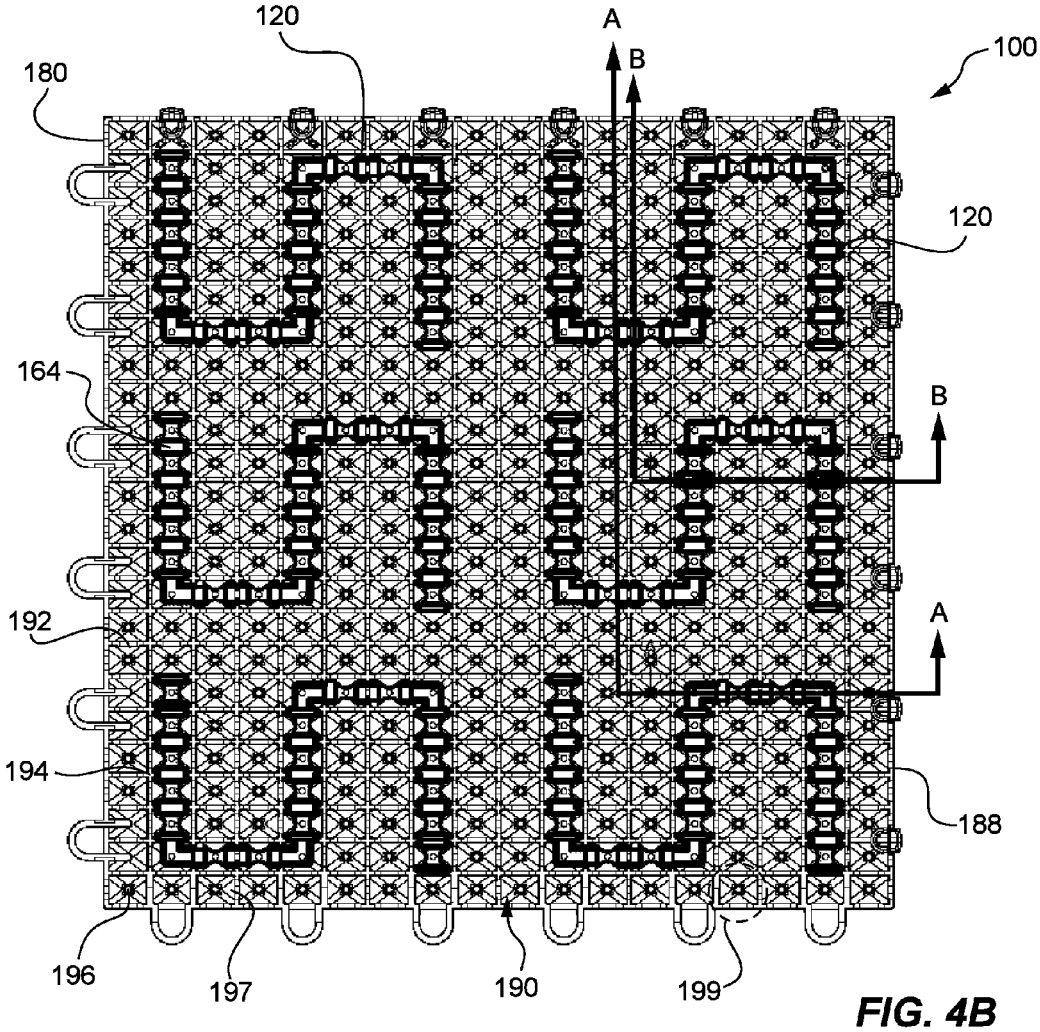

Referring now to FIGS. 4A and 4B, six of the compliant inserts 120 described and illustrated in FIGS. 3A-3C can be installed to the tile support structure 190 of a single modular floor tile 180 to form a representative embodiment 100 of the modular tile system. In this embodiment the tile support structure 190 comprises an array of downwardly-extending load-bearing structures that include support ribs 192, primary support posts 194 and secondary support posts 196, which group together with triangular openings 197 to form a plurality of array segments 199. The resilient or compliant inserts 120 can be distributed across the array so that elongate bodies 122 from each of the inserts are positioned within one array segment of the periphery-defining sidewalls 188, and so that no interior array segment is more than two segments removed laterally or diagonally from any elongate body 122. This can ensure that entire top surface 184 of the modular floor tile 180 is uniformly supported by the plurality of compliant inserts 120.

Referring to FIG. 4B, the summation of all the contact flats 164 of the six compliant inserts 120 supporting the floor tile 180 can be a controllable fraction of the total surface area of the tile 180. This can advantageously allow the designer of the modular tile system 100 to control the traction of the tile system and configure whether the compliant inserts grip or slide over the underlying ground surface.

Figure 5A:
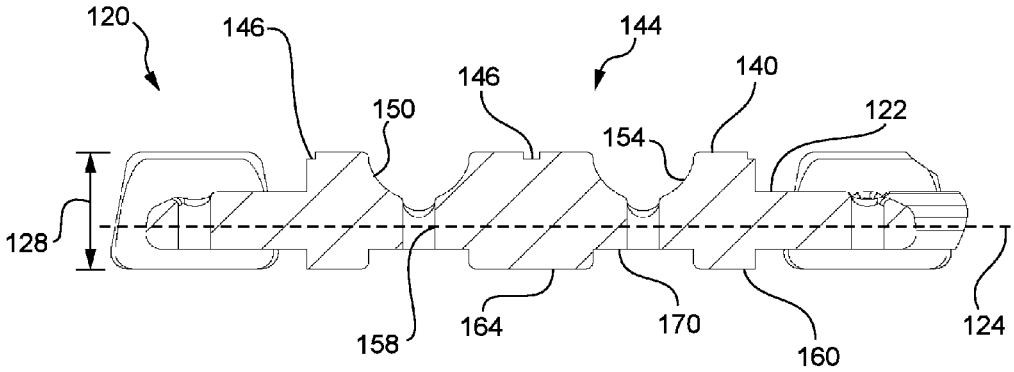
FIGS. 5A-5B together illustrate cross-sectional side views of the isolated compliant insert and assembled modular tile system of FIG. 4, respectively, as viewed from Section Line A-A.
Figure 5B:
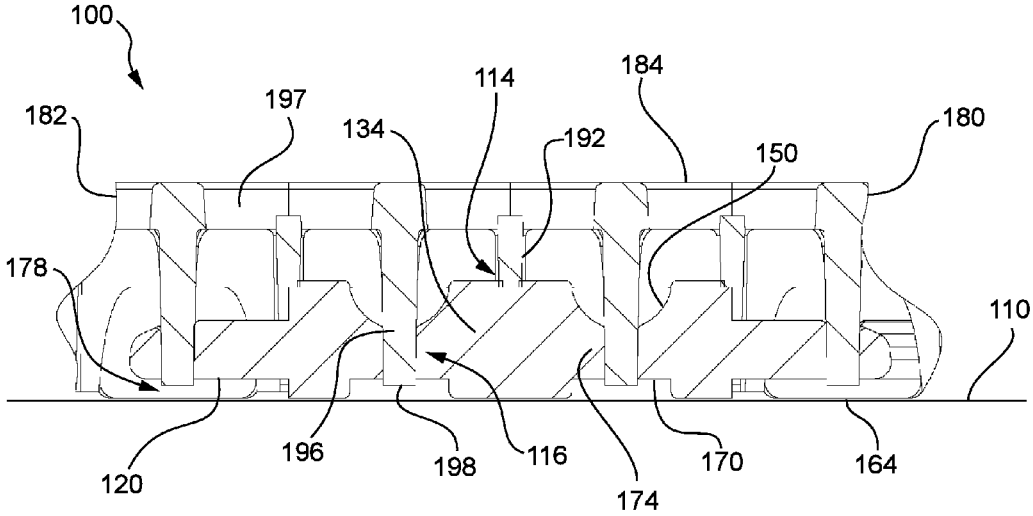

Illustrated in FIG. 5A is a cross-sectional side view of the isolated resilient or compliant insert 120 as viewed from section line A-A of FIG. 4B, which is cut along the longitudinal centerline axis of one of the elongate bodies or segments 122 forming the compliant insert. FIG. 5B further illustrates the assembled modular tile system 100 with both the compliant insert 120 and the modular floor tile 180, as taken along the same section line. The attachment interfaces can comprise top grooves 146 which couple to support ribs 192 of the tile support structure 190 to create a rib/groove interconnection 114, as well as attachment holes 158 which couple to secondary support posts 196 to create post/hole interconnections 116. The top face 140 of the elongate body 22 can also include top drainage channels 150 slopping downward toward the attachment holes.

The bottom face 160 can several contact flats 164 separated by upwardly-directed drainage recesses 170. The drainage recesses can be axially aligned with the top drainage channels 150 on the longitudinal axis 124 to form the necked portions 174 of the elongate body that can facilitate drainage of liquids passing through holes in the floor tile 180 above. Similarly, the contact flats 164 can be axially aligned with the attachment interfaces 144 to form the load bearing support columns 134 which flexibly elevate the support structure 190 above the ground surface 110.

The elongate body is configured with a predetermined height or thickness 128, which in combination with the depth of the top groove 146 of the attachment groove, is sufficient to raise the contact surfaces 198 of the downwardly-extending load-bearing structures, such as the secondary support post 196, a predetermined distance 178 above the ground surface 110 when the top groove is fully inserted about a support rib 192. In one exemplary embodiment the predetermined distance 178 between the secondary support post 198 and the ground surface 110 can range from about 0.5 millimeters to about 2.5 millimeters, with a preferred distanced being about 1.5 millimeters.

Figure 6A:
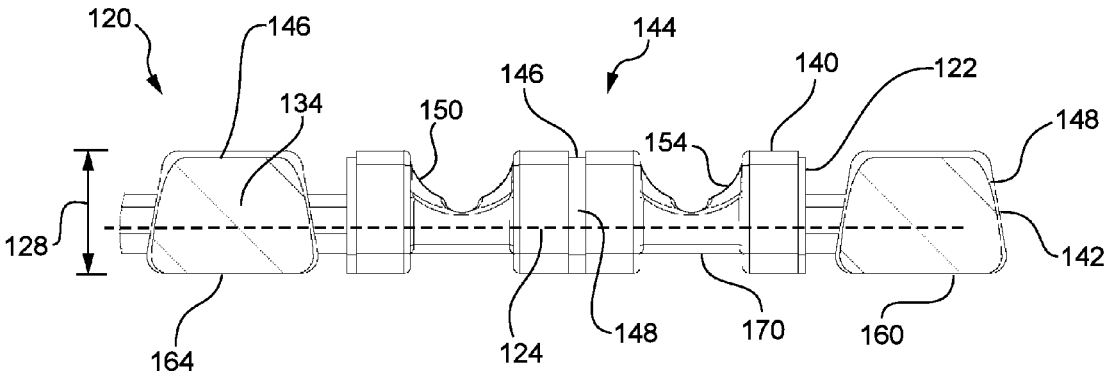
FIGS. 6A-6B together illustrate cross-sectional side views of the isolated compliant insert and assembled modular tile system of FIG. 4, respectively, as viewed from Section Line B-B.
Figure 6B:
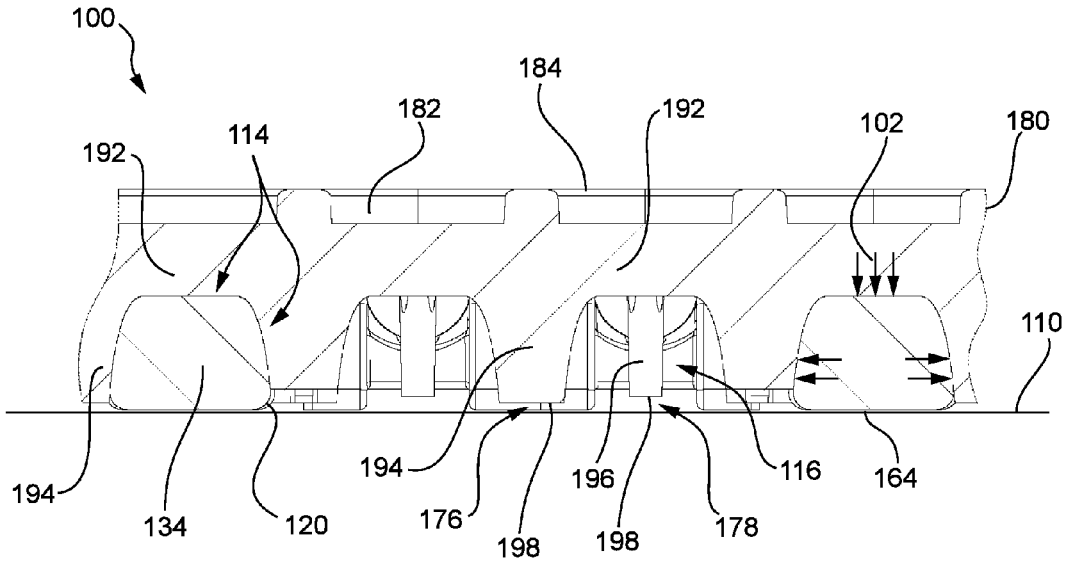

Illustrated in FIGS. 6A-6B is a cross-sectional side view of another isolated resilient or compliant insert 120 and the assembled modular tile system 100 as taken along section line B-B of FIG. 4B which cuts perpendicular to the longitudinal centerline axes and expanded portions of two elongate bodies 122. Both drawings further illustrate the axial alignment of the attachment interface 144 in the top face 140 with the contact flats 164 in the bottom face 160 to form the load-bearing support columns 134 which elastically absorb and transfer a portion of the forces received on the top surface 184 of the modular floor tile 180 to the ground surface 110.

Also shown in FIG. 6B is the grid or array of supporting ribs 192 arching downwards to merge with intersecting and adjacent support ribs and forming a primary support post 194 having a cross-shaped footprint at its contact bottom 198 with the ground surface 110. In this configuration the top grooves 146 formed into the top surface 140 of the elongate body can continue around the side faces 142 to provide side grooves 148 that are adapted to receive the laterally-projecting portions of the primary support posts. Thus, the compliant insert 120 can be securely attached to the underside support structure 190 of the modular floor tile with a plurality of three-sided rib/groove interconnections 114 which can extend across the top and down around both sides of the elongate body 122 with a slight interference fit.

In the embodiment 100 of the modular tile system illustrated in both FIGS. 5B and 6B, moreover, the three-sided rib/groove interconnections 114 can combine with the post/hole interconnections 116 to mechanically secure the compliant insert 120 to prevent the elongate body 122 from rolling or twisting relative to the floor tile in response to a horizontal component in the applied load. Furthermore, no additional adhesive or other attachment mechanism may be necessary, which can allow for the non-destructive removal and replacement of a compliant insert with an identical compliant insert during a repair, or with a different compliant insert having a modified shape and/or different material properties. Thus, it is possible for the modular floor tile system 110 of the present invention to be reconfigured with different load-bearing performance characteristics if so desired.

Like the secondary support posts above, a predetermined distance 176 between the primary support posts 196 and the ground surface 110 can also range from about 0.5 millimeters to about 2.5 millimeters, with a preferred distanced being about 1.5 millimeters. However, the distance 176 can be greater or less than distance 178, so as to control which group of support posts come into contact with the ground surface first when the compliant insert is compressed.

As previously stated, moreover, the compliant inserts 120 can be formed from a more-flexible plastic or rubber-like material having a elastic modulus that is less than the elastic modulus of the floor tiles, and when attached to the underside tile support structure can elastically compress and deform prior to the tile support structure 190 to provide the modular tile system 100 with a greater level of compliance. Furthermore, the tile support structure 90 can also include a plurality of load-bearing members having different levels of compliance and damping. For instance, the primary support posts 194 can be elevated a first distance 176 above the ground surface 110 by the compliant inserts 120, while the secondary support posts 196 can have a slightly greater clearance 178 between their contact surfaces 198 and the ground. As a result, the primary support posts 194 can be the first load-bearing structures of the modular floor tile 180 which come into contact with the ground surface as the compliant inserts 120 elastically compress in response to an high load, such as an impact. The primary support posts 194 can then provide a second level of stiffness and damping as they deflect or deform until the secondary support posts 196 come into contact the ground surface and assume the remainder of the load.

Thus, in one aspect of the present invention the modular floor tile system 100 can provide multiple levels of stiffness and damping, namely a first level as the compliant inserts 120 compress, a second level as the more-rigid primary support posts 194 contact the ground and deflect, and finally a third level when the most-rigid secondary support posts 196 contact the ground surface. Furthermore, as the elongate body 122 of the compliant insert 120 is compressed by a force 102 applied to the top face 140 through the attachment interface 144, the side faces 142 of the elongate body can to press outwards against the primary support posts 194 (FIG. 6B) to the bending of the surrounding primary support posts 194 prior to their coming into contact with the ground surface.

The foregoing detailed description describes the invention with reference to specific representative embodiments. However, it will be appreciated that various modifications and changes can be made without departing from the scope of the present invention as set forth in the appended claims. The detailed description and accompanying drawings are to be regarded as illustrative, rather than restrictive, and any such modifications or changes are intended to fall within the scope of the present invention as described and set forth herein.

More specifically, while illustrative representative embodiments of the invention have been described herein, the present invention is not limited to these embodiments, but includes any and all embodiments having modifications, omissions, combinations (e.g., of aspects across various embodiments), adaptations and/or alterations as would be appreciated by those skilled in the art based on the foregoing detailed description. The limitations in the claims are to be interpreted broadly based on the language employed in the claims and not limited to examples described in the foregoing detailed description or during the prosecution of the application, which examples are to be construed as non-exclusive. For example, any steps recited in any method or process claims, furthermore, may be executed in any order and are not limited to the order presented in the claims. The term "preferably" is also non-exclusive where it is intended to mean "preferably, but not limited to." Accordingly, the scope of the invention should be determined solely by the appended claims and their legal equivalents, rather than by the descriptions and examples given above.

What is claimed and desired to be secured by Letters Patent is:

1. A compliant insert for flexibly supporting a synthetic floor tile above a ground surface, the insert comprising:
- at least one elongate body having a longitudinal axis oriented parallel to a top surface of the floor tile;
- a top face of the elongate body having an attachment interface for coupling to a tile support structure extending downward from an underside of the floor tile; and
- a bottom face of the elongate body comprising:
  - at least one contact flat for contacting the ground surface; and
  - at least one upwardly-directed recess for allowing liquids to flow underneath the insert from a first lateral side of the elongate body to a second lateral side of the elongate body,
- wherein the elongate body has a thickness and stiffness sufficient, in an unloaded state, to elevate the support structure a distance above the ground surface.

2. The compliant insert of claim 1, further comprising a plurality of upwardly-directed recesses sub-dividing the at least one contact flat into a plurality of contact flats.

3. The compliant insert of claim 2, further comprising a plurality of drainage channels formed into the top face of the elongate body and sub-dividing the attachment interface into a plurality of attachment interfaces.

4. The compliant insert of claim 3, wherein the plurality of contact flats are axially aligned with the plurality of attachment interfaces and provide a plurality of support columns between the ground surface and the floor tile.

5. The compliant insert of claim 1, wherein the attachment interface comprises a groove of pre-determined width that forms a rib/groove interconnection with a rib of the tile support structure having a corresponding width.

6. The compliant insert of claim 5, wherein the groove and each rib/groove interconnection substantially circumscribes the upper and side faces of the elongate body.

7. The compliant insert of claim 1, wherein the attachment interface further comprises a series of holes formed through the elongate body and adapted to receive a support post of the tile support structure.

8. The compliant insert of claim 1, wherein the at least one elongate body further comprises a plurality of elongate bodies joined together at an angle to form a shaped elongate insert supporting the floor tile in a plane.

9. A compliant insert for flexibly supporting a synthetic floor tile above a ground surface, the insert comprising:
- at least one compressible elongate body having a longitudinal axis oriented parallel to a top surface of the floor tile;
- a bottom face of the elongate body having at least one contact flat for contacting the ground surface; and
- a top face of the elongate body having an attachment interface for coupling the insert to a tile support structure extending downwardly from an underside of the floor tile, wherein the compressible elongate member has a thickness and stiffness sufficient, in an unloaded state, to elevate the bottom of the support structure a distance above the ground surface and to compress to allow the bottom of the support structure to come into contact with the ground in a loaded state; and at least one drainage recess for channeling liquids from a first lateral side of the elongate body to a second lateral side of the elongate body.

10. The compliant insert of claim 9, further comprising a plurality of drainage channels sub-dividing the attachment interface into a plurality of attachment interfaces.

11. The compliant insert of claim 10, wherein each of the plurality of drainage channels has a curvilinear shape with a radius of curvature ranging between 0.1 inch and 0.5 inch.

12. The compliant insert of claim 9, wherein the at least one drainage recess extends from a top face to a side face of the elongate body.

13. A compliant insert for flexibly supporting a synthetic floor tile above a ground surface, the insert comprising:

at least one elongate body having a longitudinal axis oriented parallel to a top surface of the floor tile, and with a thickness and stiffness sufficient, in an unloaded state, to elevate a bottom of the floor tile a distance above the ground surface and compress to allow the bottom of the floor tile to come into contact with the ground in a loaded state;

a bottom face of the elongate body having at least one contact flat for contacting the ground surface; and a top face of the elongate body having at least one attachment groove formed therein for receiving a support rib extending downwardly from an underside of the floor tile to establish a rib/groove interconnection coupling the insert to the floor tile, wherein a portion of said attachment groove is substantially parallel to a top surface of the floor tile and further comprising a plurality of attachment grooves transverse to the longitudinal axis for receiving a grid of support ribs therein to establish a plurality of rib/groove interconnections.

14. A modular tile system forming a partially-compliant floor covering over a ground surface, the tile system comprising:

a modular floor tile, comprising:

a substantially planar body having a top surface; and a tile support structure extending downwardly from an underside of the planar body; and at least one compliant insert, comprising:

at least one compressible elongate body having a longitudinal axis oriented parallel to the top surface of the floor tile having a thickness and stiffness sufficient, in an unloaded state, to elevate a bottom surface of the tile support structure a distance above the ground surface and compress sufficient to permit the bottom surface of the tile support structure to come in contact with the ground surface when in a loaded state;

a bottom face of the elongate body having at least one contact flat for contacting the ground surface;

a top face of the elongate body having at least one attachment interface for coupling the insert to the tile support structure; and at least one drainage channel transverse to the longitudinal axis and substantially parallel to the top surface of the tile for channeling liquids away from the floor tile.

15. The tile system of claim 14, wherein the at least one elongate body further comprises a plurality of elongate bodies joined together at an angle to form a shaped elongate insert supporting the floor tile in a plane.

16. The tile system of claim 14, wherein the at least one drainage channel further comprises a plurality of top and side drainage portions sub-dividing the at least one elongate body into a plurality of support columns between the ground surface and the modular floor tile.

17. A modular floor tile for forming a partially-compliant floor covering over a ground surface, the floor tile comprising:

a substantially planar body having a top surface;

a tile support structure extending downwardly from an underside of the planar body, said tile support structure having a bottom surface configured to rest on the ground surface; and at least one compressible elongate body having a longitudinal axis oriented parallel to the top surface of the floor tile having a thickness and stiffness sufficient, in an unloaded state, to elevate the bottom surface of the tile support structure a distance above the ground surface and compress to allow the bottom surface of the tile support structure to come into contact with the ground in a loaded state, the elongate body comprising:

a bottom face having at least one contact flat for contacting the ground surface;

a top face having at least one attachment interface for coupling the elongate body to the tile support structure; and at least one drainage channel disposed atop the elongate body transverse to the longitudinal axis and substantially parallel to a top surface of the floor tile for channeling liquids away from the floor tile.

18. The modular floor tile of claim 17, wherein the attachment interface comprises a groove of pre-determined width that forms a rib/groove interconnection with a rib of the tile support structure having a corresponding width.

19. The modular floor tile of claim 18, wherein each rib/groove interconnection substantially circumscribes the upper and side faces of the elongate body.

20. The modular floor tile of claim 17, wherein the attachment interface further comprises a series of holes formed through the elongate body and adapted to receive a support post of the tile support structure.

21. The modular floor tile of claim 20, wherein the holes are formed in the drainage recess of the elongate body.

22. The modular floor tile of claim 17, further comprising at least one upwardly directed drainage recess disposed in the bottom of the elongate body for allowing liquids to flow underneath the insert from a first lateral side of the elongate body to a second lateral side of the elongate body, wherein the upwardly directed drainage recess is disposed beneath the drainage channel.

* * * * *